United States Patent [19]

Hiraoka et al.

[11] Patent Number: 4,699,368

[45] Date of Patent: Oct. 13, 1987

[54] AUTOMATIC SHEET WINDING AND OUTPUTTING APPARATUS

[75] Inventors: Shinitiro Hiraoka, Yamatotakada; Hideo Matsuda, Nara, both of Japan

[73] Assignee: Sharp Kabushiki Kaisha, Osaka, Japan

[21] Appl. No.: 721,937

[22] Filed: Apr. 11, 1985

[30] Foreign Application Priority Data

Apr. 13, 1984 [JP] Japan ..... 59-75543
Sep. 3, 1984 [JP] Japan ..... 59-185123

[51] Int. Cl.[4] ..... B65H 5/12

[52] U.S. Cl. ..... 271/82; 101/408; 271/277; 355/75

[58] Field of Search ..... 355/3 R, 3 DR, 3 SH, 355/14 SH, 75, 104; 271/82, 275, 277; 101/408, 409, 410

[56] References Cited

U.S. PATENT DOCUMENTS 3,196,767 7/1965 Eichorn ..... 271/277 X
3,734,607 5/1973 Davis et al. ..... 355/4
4,033,575 7/1977 Fujimoto ..... 271/277 X
4,259,695 3/1981 Nakano ..... 271/277 X
4,290,595 9/1981 Thunker ..... 271/277
4,320,963 3/1982 Satomi ..... 355/75 X

FOREIGN PATENT DOCUMENTS 2645624 4/1977 Fed. Rep. of Germany .
2557866 6/1977 Fed. Rep. of Germany .

*Primary Examiner*—Fred L. Braun
*Attorney, Agent, or Firm*—Birch, Stewart, Kolasch & Birch

[57] ABSTRACT

An automatic sheet-like winding and outputting apparatus with a drum for mounting a sheet-like member, a first claw for catching the front edge of the sheet-like member, a second claw for gripping the sheet-like member in cooperation with the first claw, and a cam member for driving the first and second claws in accordance with the rotation of the drum. The second claw is also operated to separate the front edge of the sheet-like member from the drum. A sheet pressure member is further provided for pressing the sheet-like member toward the surface of the drum thereby pressing the sheet-like member in close contact with that surface.

4 Claims, 17 Drawing Figures

AUTOMATIC SHEET WINDING AND OUTPUTTING APPARATUS

BACKGROUND OF THE INVENTION

The present invention relates to a sheet winding and outputting apparatus used for an electrophotographic copying machine, a facsimile machine, or the like and, more particularly, to an automatic winding and outputting apparatus for winding a sheet-like member, such as a sheet of paper or a file around a drum, including an electrophotographic copying machine, a facsimile machine, and the like.

Conventional apparatuses with a drum for winding and outputting a sheet of paper are provided, by way of example, in an electrophotographic copying machine in which an original is wound around a drum, or a fascimile machine in which a drum is provided for rolling an original and a sheet of recording paper. Conventionally, such an apparatus is so complex so as not to be compact. The front edge of the sheet tends to be mismatched with the drum. As a result, it may be difficult to output the sheet from the drum.

SUMMARY OF THE INVENTION

Accordingly, it is an object of the present invention to provide an improved sheet winding and outputting compact apparatus for automatically rolling and outputting a sheet when a drum is stopped or rotated, so that the sheet can be wound around and outputted from the apparatus, smooth.

It is another object of the present invention to provide an improved automatic sheet winding and outputting apparatus, suitable for an electrophotographic copying machine or a facsimile machine, for automatically winding and outputting a sheet-like member around a drum, smoothly, in such a machine.

It is a further object of the present invention to provide an improved automatic winding and outputting apparatus, in a facsimile machine or an electrophotographic copying machine, for automatically winding and outputting a sheet-like member such as original paper or copy paper, around a drum, the apparatus being provided with a sheet pressure means for preventing the paper from floating from the surface of the apparatus, so that the whole area of the paper can be exposed to light exposure or can be read-out.

Briefly described, in accordance with the present invention, an automatic winding and outputting apparatus suitable for a facsimile machine or an electrophotographic copying machine comprises a rotatable drum means for supporting a sheet-like member, first claw means for catching the front edge of the sheet-like member, second claw means for gripping the front edge of the sheet-like member in cooperation with the first claw means, the second claw means being further operated to separate the rear edge of the sheet-like member from the drum means, and cam means for driving the first and second claw means in accordance with the rotation of the drum means.

The sheet pressure means is further provided for pressing the sheet toward the surface of the drum means, so that the sheet is prevented from floating from the surface of the drum means.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
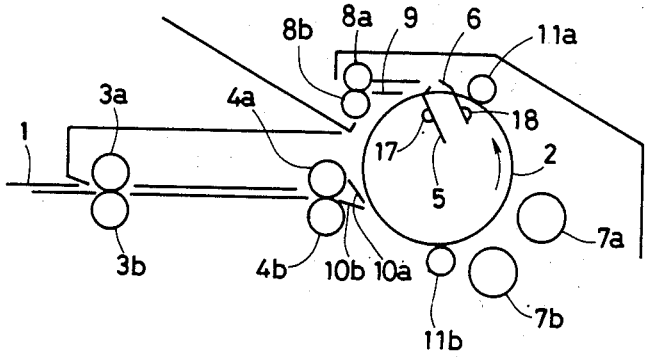
FIG. 1 is a side view of an automatic winding and outputting apparatus applied to part of an electrophotographic copying machine according to a first preferred embodiment of the present invention.

FIG. 1 is a side view of an automatic winding and outputting apparatus of the present invention, being applied, by way of example, to an original winding drum of an electrophotographic copying machine. The present invention can be applied to any other machine, with a rotatable drum for supporting a sheet-like member, such as a facsimile machine.

With reference to FIG. 1, an original 1 is supplied to the copying machine to make a copy thereof. The original 1 is fed by a pair of paper feed rollers 3*a* and 3*b*, and a pair of timing rollers 4*a* and 4*b* toward an original mounting portion near which two claws 5 and 6 of a drum 2 are provided. The front edge of the original 1 is gripped by the two claws 5 and 6 while winding the original 1 around the drum 2. Two light sources 7*a* and 7*b* are illuminated to cause light exposure of the original 1. The drum 2 can revolve by a predetermined number set to repeat the exposure operation. After the copying operations, the grip of the original 1 by the two claws 5 and 6 is released and the original 1 can be separated from the drum 2 by the operation of the claw 6. Thereafter, the original 1 is outputted by a pair of exhaust rollers 8*a* and 8*b*.

Figure 2:
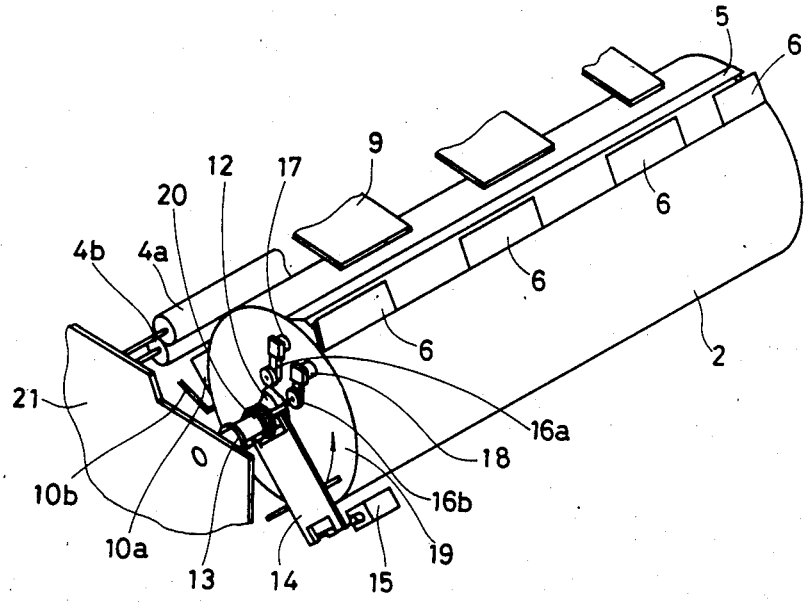
FIG. 2 is a perspective view of a rotative drum used in the apparatus of FIG. 1.
Figure 3:
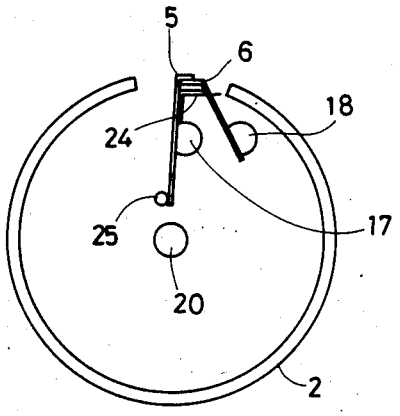
FIG. 3 is a side view of the rotatable drum of FIG. 2.

FIGS. 2 and 3 show the drum 2 and the peripheral members. The first claw 5 is attached to a shaft 17 supported on a side plate 19 while the second claw 6 is attached to a shaft 18 supported on the side plate 19. A drum shaft 20 is provided for supporting and revoluting the drum 2. The drum shaft 20 is provided with a cam member 12 comprising cams 12*a* and 12*b*, and a compression coil spring 18. The cam member 12 is fixed so as not to be related with the revolution of the shaft 20. The compression coil spring 18 is provided for pressing the cam member 12 toward a side plate 19 of the drum 2. A stopper 25 is provided for stopping the further rotation of the claw 5.

Cam followers 16*a* and 16*b* are provided being coupled to the shafts 17 and 18, respectively. As the rotatable drum 2 is rotated in the direction of the arrow of FIG. 2, the cam followers 16*a* and 16*b* contact the related cams 12*a* and 12*b*, respectively, so that the shafts 17 and 18 can be rotated at a predetermined angle. In accordance with the rotation of the shafts 17 and 18, the claws 5 and 6 open and close.

A plate 14 is provided for moving the cam member 12. A solenoid 15 is provided for moving the plate 14 along the longitudinal direction of the shaft 20. Hence, the cam member 12 is separated from the cam followers 16*a* and 16*b*, and positioned adjacent to a frame 21 of the drum 2. Thus, the drum 2 winding the original 1 can be rotated by a set number, without outputting the original 1 from the drum surface.

Figure 4:
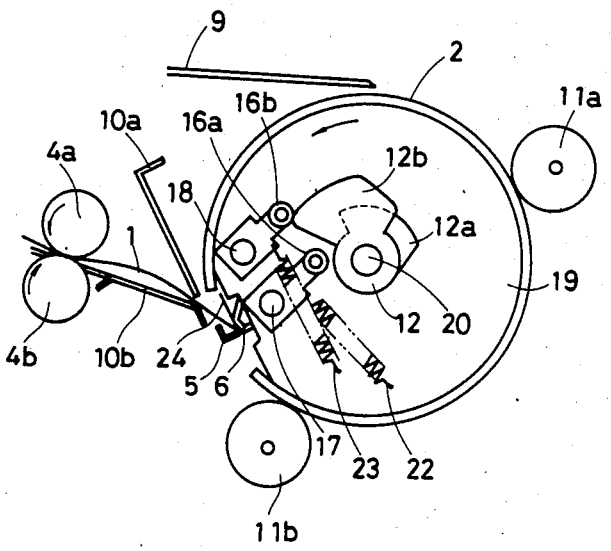
FIGS. 4 and 5 are side view of the apparatus when original paper is first wound around the rotatable drum.
Figure 5:
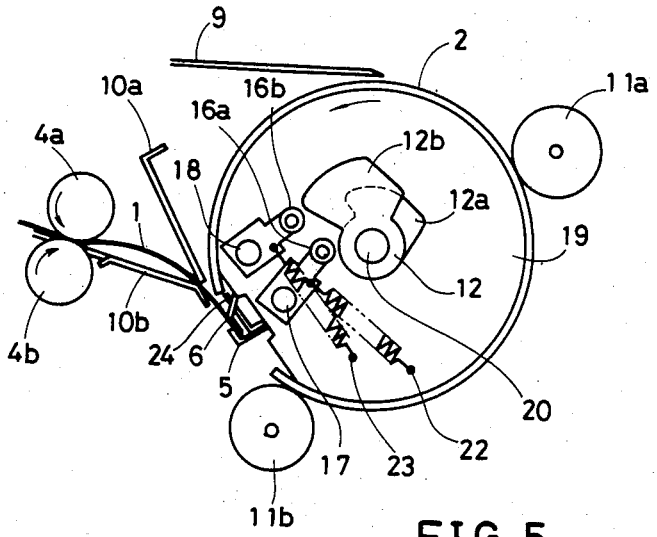

The operation of the drum 2 will be described as follows. FIGS. 4 and 5 show a condition to wind the original 1 around the drum 2. The two claws 5 and 6 are stressed for clockwise rotation by two extending coil springs 22 and 23. The cams 12*a* and 12*b* are positioned as shown in FIG. 4 in synchronization with the opening and closing operation of the claws 5 and 6. When the drum 2 is rotated to wind the original 1, the claw 5 is closed because the cam follower 16*a* is separated from the cam 12*a*, and the claw 6 is inwardly opened because the cam follower 16*b* is lifted by the cam 12*b*. On the other hand, the original 1 is forwarded by the pair of feed rollers 3*a* and 3*b*, and stopped at the pair of timing rollers 4*a* and 4*b*. When the claws 5 and 6 for supporting the original 1 are rotated to the predetermined position, the waiting original 1 is further forwarded at a speed faster than the revolution of the drum 2, so that the original 1 is inserted between the claw 5 and a guide 24. As shown in FIG. 5, the cam follower 16*b* is separated from the cam 12*b*, so that the claw 6 presses the front edge of the original 1 toward the claw 5. As the drum 2 is further rotated to a position at which the original 1 is supported by the force of the extending coil spring 23, the original 1 can be completely wound and attached around the surface of the drum 2.

After the drum 2 starts to wind the original 1, the energization of the timing roller 4*b* is stopped. This is because the operation of the timing roller 4*b* can stop the revolution of the drum 2 since the original forward speed of the timing roller 4*b* is faster than the revolution of the drum 2. To eliminate such a problem, a single-direction clutch may be attached at both ends of the timing roller 4*b*, so that after the timing roller 4*b* is stopped from being operated, the pulling force of the drum 2 to pull the original 1 enables a non-load revolution. The timing roller 4*a* is continually in a non-load revolution mode.

Figure 6:
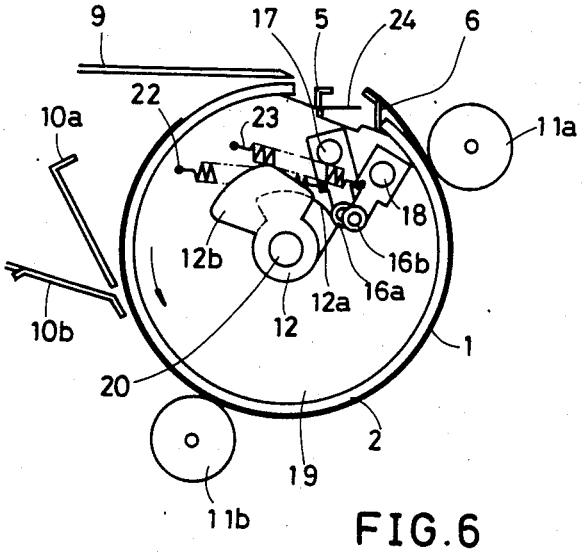
FIGS. 6 and 7 are side views of the apparatus when the wound original begins to separate from the surface of the apparatus.
Figure 7:
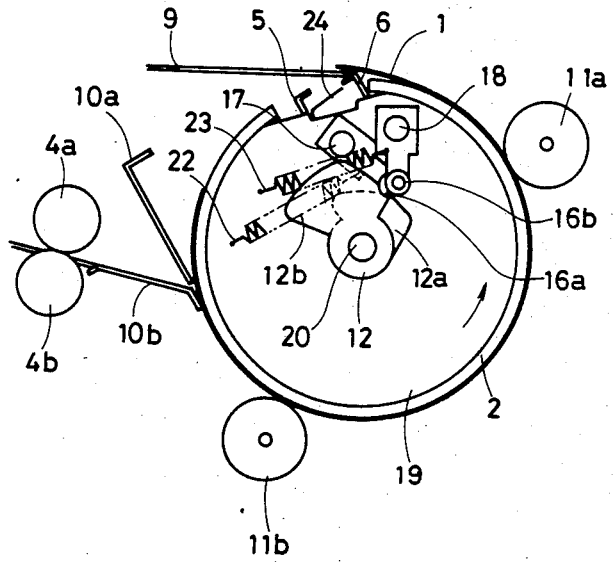

FIGS. 6 and 7 show a condition to separate the wound original 1 from the drum 2. When the original support portion with the claws 5 and 6 of the drum 2 is near to an original output portion, the cam 12*a* lifts the cam follower 16*a* to open the claw 5. As the claw 5 is opened, the claw 6 for pressing the original 1 toward the claw 5 with the force of the extending coil spring 23 is outwardly opened. Therefore, the claw 6 lifts the front edge of the original 1 above an output guide 9, thereby outputting the original 1. That is, when the original support portion of the drum 2 passes nearby the output guide 9 positioned at the original output portion, the claw 6 can pass nearby the output guide 9 without making contact with the output guide 9 even when the claw 6, together with the original 1, is projected from the surface of the drum 2. This is because the output guide 9 and the claw 6 are positioned so as to be staggered from each other. Only the original 1 can make contact with the output guide 9, so that in accordance with the revolution of the drum 2, the original 1 can be separated and outputted by cooperation of a sheet pressing roller 11(11*a* and 11*b*), the output guide 9, and the output rollers 8*a* and 8*b*. Before the drum 2 is rotated to the original support position, the claws 5 and 6 return to their original waiting position.

Figure 8:
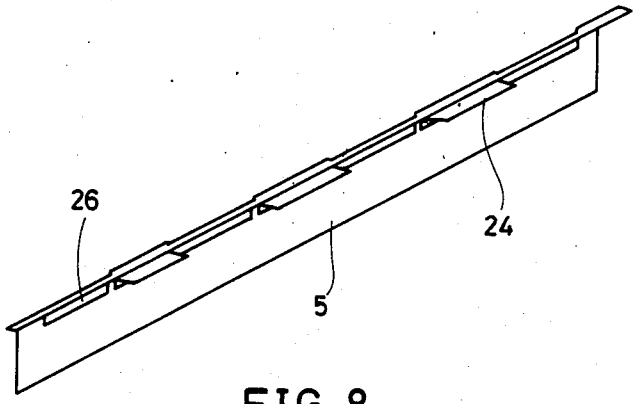
FIG. 8 is a perspective view of a first claw used for the apparatus.

As shown in FIG. 2, the claw 6 is formed in a discrete shape, so that the claw 6 does not conflict with the output guide 9. As shown in FIG. 8, the claw 5 is provided with an opening 26 so that when the claw 6 and the guide 24, which is provided at the same position as the output guide 9, are inwardly opened in the original waiting condition as shown in FIG. 4, the claw 6 does not conflict with the claw 5. Thus, while the drum 2 is rotated in one direction, the original 1 can be automatically wound around and separated from it.

Figure 9:
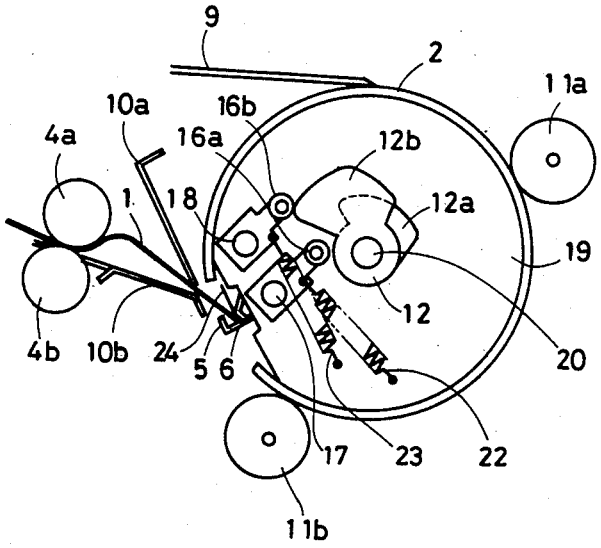
FIG. 9 is a side view of the apparatus according to a second preferred embodiment of the present invention while the rotatable drum is stopped and the original is wound around the drum.

According to a second preferred embodiment of the present invention, FIG. 9 shows the construction of the apparatus for stopping the revolution of the drum 2 to mount the original 1. The drum 2 is stopped at the original mounting position, in which, using the pair of timing rollers 4*a* and 4*b*, the original 1 is inserted between the claw 5 and the guide 24. The pair of timing rollers 4*a* and 4*b* push the original 1 up to the claw 5, so that the original 1 is waved by the supply force of the pair of guides 10*a* and 10*b*. The claw 6 pushes the front edge of the original 1 to the claw 5, so that the front edge of the original 1 can push the claw 5, even when the drum 2 can be rotated to the position in which the extending coil spring 23 can support the original 1, as shown in FIG. 5. Therefore, even when the pair of timing rollers 4*a* and 4*b* are stopped, the drum 2 is rotated to the original mounting position to mount the original 1. After mounting, as the drum 2 is rotated, the original 1 can be wound around the drum 2. Meanwhile, the pair of timing rollers 4*a* and 4*b* are rotated with an one-direction clutch without any load in the same manner as the case where the drum 2 is rotated to mount the original 1.

Otherwise, to stop the revolution of the drum 2 to mount the original 1, after the drum 2 is stopped at the original mounting position, the original 1 is inserted between the claw 5 and the guide 24 by the pair of timing rollers 4*a* and 4*b*, so that when the original 1 reaches the position of the claw 5, and then the original 1 is passed between the claw 5 and the paper supply guides 10*a* and 10*b* as shown in FIG. 9, the drum 2 is rotated again. At this time, the pair of timing rollers 4*a* and 4*b* are not stopped and they can supply the original 1 at the same speed as the rotation speed of the drum 2, and the original 1 can be wound around the drum 2. It is unnecessary to provide the one-direction clutch at the timing rollers, thereby making the control simpler.

Attention should now be directed to a third preferred embodiment of the present invention, in which a sheet pressure means is provided for preventing the original 1 from floating, so that the entire area of the original 1 can be read-out and exposed to light scanning.

Figure 10:
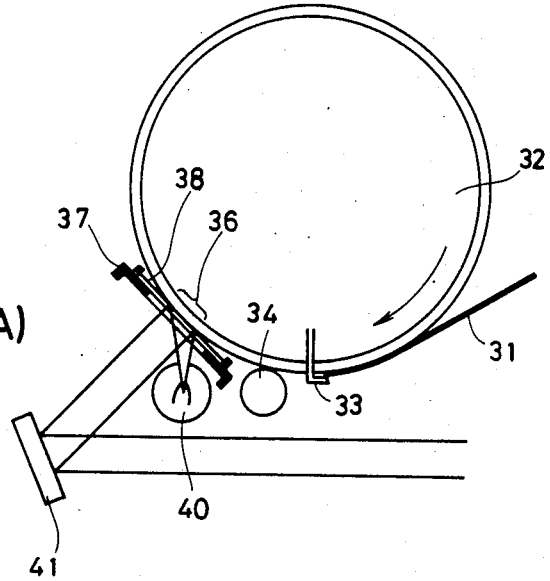
FIGS. 10(A) and 10(B) are a side view of an automatic winding and outputting apparatus according to a third preferred embodiment of the present invention.
Figure 10:
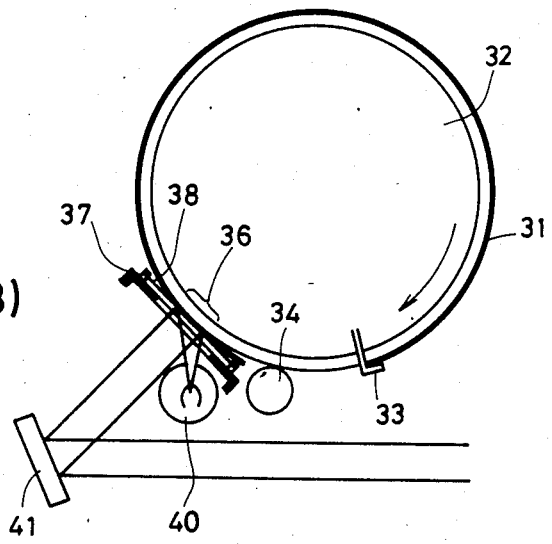

FIGS. 10(A) and 10(B) are a side view of an automatic sheet winding and output apparatus according to the third preferred embodiment of the present invention.

With reference to FIGS. 10(A) and 10(B), there are seen an original 31, a rotatable drum 32, a sheet front-edge pressing claw 33, a pressure roller 34, and a light exposure lamp 40, and a mirror 41. The sheet front-edge pressing claw 33 is provided for pressing the front edge of the original 31. A light exposure portion 36 is formed by the lamp 40. Reflected light from the exposure portion 36 is forwarded by the mirror 41 to a photoreceptor of an electrophotographic copying machine or a photosensitive member of a fascimile machine.

Figure 11:
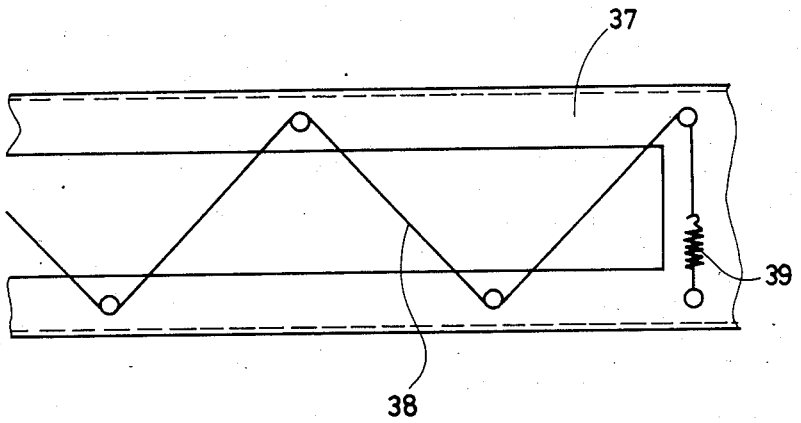
FIG. 11 is a front view of a sheet pressure member used for the apparatus of FIGS. 10(A) and 10(B)

FIG. 11 shows an original pressure member 37 applied to the apparatus of FIGS. 10(A) and 10(B). The original pressure member 37 serves to press the original 31 toward the drum 32. It is positioned as being faced to the light exposure portion 36. As shown in FIG. 11, the original pressure member 37 is provided with an elongated frame, some pins projected from the frame, and a single wire 38 extended between the pins, obliquely crossing the plane defined by the frame. A spring 39 is provided at one or both ends of the wire 38 for extending the wire 38, thereby preventing the wire from being broken due to too much strength. Preferably, the wire may comprise a tungsten wire of about 0.1 mm in diameter.

As shown in FIGS. 10(A) and 10(B), the original 31 supported by the original front-edge pressing claw 33 can pass through the pressing roller 34 and the original pressure member 37 in accordance with the rotation of the drum 32. During by the original pressure member 37, the original 31 is exposed to the light from the lamp 40 through the original pressure member 37. The wire 38 of the original pressing member 37 serves to press the original 31 at the light exposure position 36. The rear edge of the original 31 can be prevented from floating as shown in FIG. 10(B). Therefore, the whole area of the original 31 can be read-out or exposed to light.

Because the light exposure is carried out widely and the wire 38 of the original pressure member 37 is obliquely extended, the wire cannot disturbe the exposure of the exposure portion 36. The reading image cannot be disturbed by the presence of the wire 38. Even when the diameter of the wire 38 is large, the property of the read image cannot be influenced other than the possibility that the image may be darken due to small light exposure amount.

Figure 12:
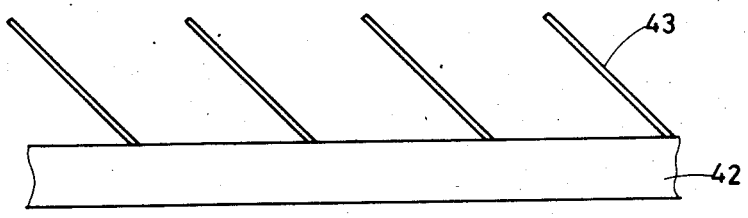
FIG. 12 is a front view of another sheet pressure member.
Figure 13:
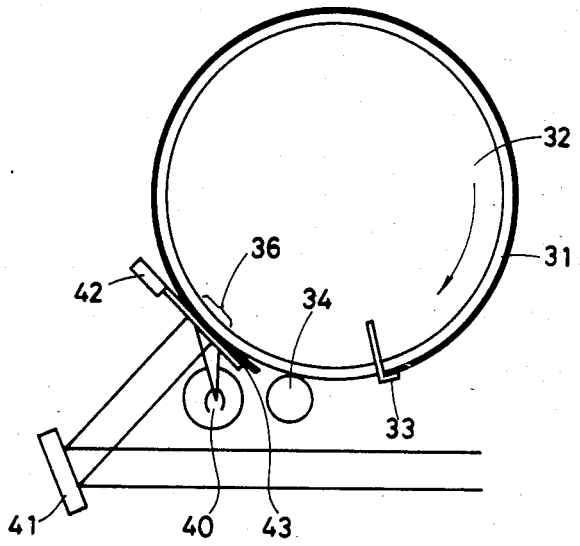
FIG. 13 is an illustration showing operational conditions of the sheet pressure member of FIG. 12.

FIG. 12 shows another original pressure member 42. FIG. 13 shows an example of the apparatus of FIG. 12.

With reference to FIG. 12, the original pressure member 42 is provided with a bar to which some wires 43 such as piano wires or tungsten wires of about 0.5–1.0 mm in diameter are obliquely connected to the bar in a cantilever manner. Any effect due to the presence of the wires 43 can be eliminated because they are connected obliquely to the shaft of the rotatable drum 32. According to the sheet pressure member 42 of FIG. 12, good reliability can be expected since the diameter of the wire 43 is great.

Figure 14:
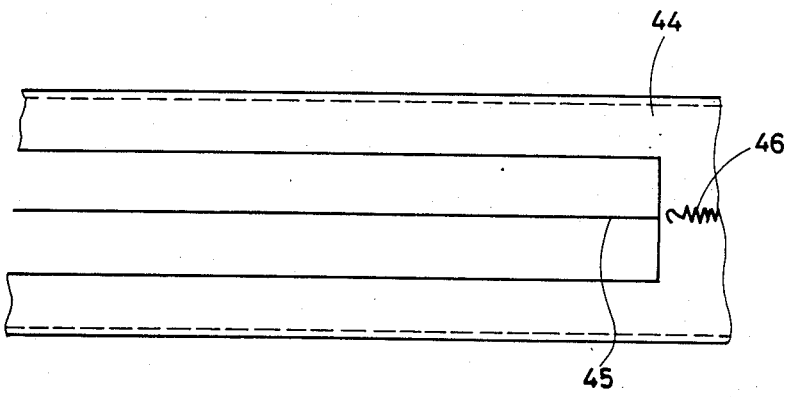
FIG. 14 is a front view of a further sheet pressure member.
Figure 15:
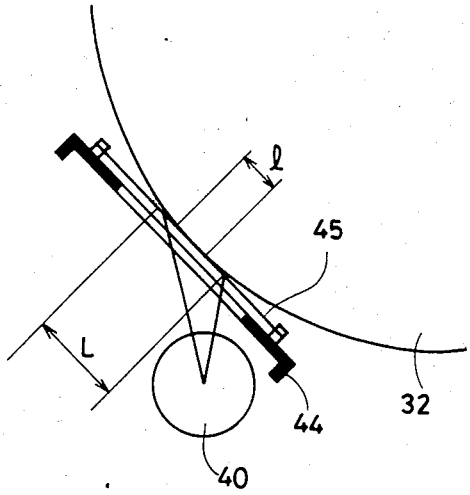
FIGS. 15 and 16 are a side view of the apparatus, showing the operational conditions of the sheet pressure member of FIG. 14.
Figure 16:
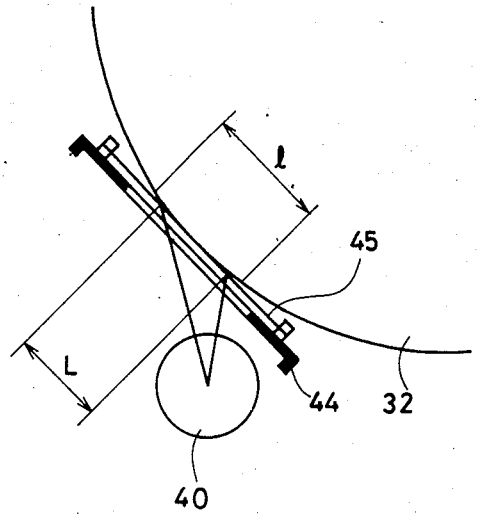

FIG. 14 shows a further original pressure member 44. This member 44 is provided with an elongated frame, a single wire 45, and a spring 46. The single wire 45 is extended along the longitudinal side of the frame 44 with the spring 46. The original pressure member 44 is provided in parallel with the shaft of the drum 32. If the pressure length "l" of the wire 45 was narrower than the width "L" of the exposure portion as shown in FIG. 15, the rear edge of the original 31 would float up, so that the record image might be effected by this floating edge. To solve this problem as shown in FIG. 16, the original pressure member 37 is in close contact with its surface of the drum 32 and pressed against the surface, so that the pressure width "l" of the wire 45 is made greater than the width "L" of the pressure portion.

In a third preferred embodiment of the present invention, it may be unnecessary to place the wire of the original pressure member 37 or 45 in close contact with the surface of the drum 32. It may be possible that a narrow clearance equivalent to the thickness of a single sheet of paper of about 50–100 micron is formed between the wire and the drum 32 to attain the same purpose.

While only certain embodiments of the present invention have been described, it will be apparent to those skilled in the art that various changes and modifications may be made therein without departing from the spirit and scope of the present invention as claimed.

What is claimed is:

1. An automatic sheet-like winding and outputting apparatus comprising:

rotatable drum means for mounting a sheet-like member thereon;

first claw means provided at the periphery of said drum means for gripping a front edge of said sheet-like member;

second claw means for gripping said front edge of said sheet-like member in cooperation with said first claw means by pressing said front edge of said sheet-like member toward said first claw means, said second claw means being further capable of separating and lifting said front edge of said sheet-like member from said drum means; and cam means for operating said first and second claw means in synchronization with the rotation of said drum means and opening and closing of said first and second claw means wherein said cam means comprises a first cam related to said first claw means and a second cam related to said second claw means.

2. The apparatus of claim 1, further comprising a coil spring means provided with said second claw means for pressing said front edge of said sheet-like member toward said first claw means.

3. The apparatus of claim 1, further comprising a sheet pressure means for pressing said sheet-like member toward the surface of said drum means so that said sheet-like member and drum means are in close contact with each other thereby eliminating floating of said sheet-like member.

4. The apparatus of claim 1, wherein said second claw means is capable of moving outward away from the rotational axis of said rotatable drum thereby lifting said front edge of said sheet-like member from said drum means.

* * * * *